US011154762B2

(12) United States Patent
Dungan

(10) Patent No.: US 11,154,762 B2
(45) Date of Patent: Oct. 26, 2021

(54) GOLF PUTTING TRAINING TOOL

(71) Applicant: Matthew Bret Dungan, Ingleside, TX (US)

(72) Inventor: Matthew Bret Dungan, Ingleside, TX (US)

( * ) Notice: Subject to any disclaimer, the term of this patent is extended or adjusted under 35 U.S.C. 154(b) by 0 days.

(21) Appl. No.: 16/853,411

(22) Filed: Apr. 20, 2020

(65) Prior Publication Data

US 2020/0330846 A1 Oct. 22, 2020

Related U.S. Application Data

(60) Provisional application No. 62/836,013, filed on Apr. 18, 2019.

(51) Int. Cl.
*A63B 69/36* (2006.01)

(52) U.S. Cl.
CPC ..... *A63B 69/3661* (2013.01)

(58) Field of Classification Search
CPC ..... A63B 69/3661; A63B 2209/00; A63B 2225/12; A63B 2071/0694
USPC ..... 473/159, 219, 240, 241, 251, 265, 267, 473/409
See application file for complete search history.

(56) References Cited

U.S. PATENT DOCUMENTS 2,460,080 A * 1/1949 Gerding ..... A63B 57/40 473/159
3,104,108 A * 9/1963 Robertson ..... A63B 69/3676 473/229
3,753,563 A * 8/1973 Previte, Jr. ..... A63B 69/3623 473/265
D233,535 S * 11/1974 Karban ..... D21/737
4,413,824 A * 11/1983 King ..... A63B 69/3685 473/240
5,052,690 A * 10/1991 Sharp ..... A63B 69/3685 473/240
5,409,231 A * 4/1995 Kueng ..... A63B 69/3676 473/157
5,919,096 A * 7/1999 Kim ..... A63B 69/36211 473/159
6,146,285 A * 11/2000 Winslow ..... A63B 69/3685 473/219
7,172,516 B2 * 2/2007 Wu ..... A63B 69/0057 473/219
7,625,296 B2 * 12/2009 Wu ..... A63B 57/0006 473/137

(Continued)

*Primary Examiner* — Nini F Legesse
(74) *Attorney, Agent, or Firm* — Runyan Law; Charles Runyan

(57) ABSTRACT

A golf putter training tool having a putter mounting base on top of an artificial green connected through a slot to a linear putting guide located beneath the artificial green. A golfer engages putter mounting base with a golf club, which is held in place by a friction or interference fit next to or on a sponge-like or rubber-like material. Practice shots made on the tool are constrained to be linear back-and-forth by linear putting guide. This constraint helps the golfer develop muscle memory for correctly aiming a put. Putter mounting base has an alignment guide against which the face of the golf club rests, constraining the face of the golf club square to the ball when the golfer makes the stroke. This constraint helps of golfer develop muscle memory for hitting the ball squarely. The tool has accessories such as a gravity ball feed mechanism.

16 Claims, 9 Drawing Sheets

(56) References Cited

U.S. PATENT DOCUMENTS

2002/0091008 A1* 7/2002 Lee ..... A63B 69/3614
473/151

* cited by examiner

GOLF PUTTING TRAINING TOOL

CROSS-REFERENCE TO RELATED APPLICATION(S)

The present application is related to and claims priority to U.S. Provisional Patent Application No. 62/836,013 filed Apr. 18, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention generally relates to the field of golf instruction tools.

BACKGROUND

Many golfers find themselves making the same mistakes when putting both short and long-range distances, whether they push or pull the ball, hit shots past the hole, or don't hit the ball square on. Other golfers lack putting consistency from improper alignment of their eyes over the ball. Unfortunately, this inconsistency is often attributed to a lack of muscle memory, which can lead to more strokes, higher scores, and depleted confidence. A suitable solution is desired.

U.S. Pat. No. 5,052,690 is directed at a golf putter with alignment means.

ABSTRACT: Disclosed is a golf club alignment device for showing a target area of a golf ball to be impacted by a golf club having a base head with a center mark calibrated to a center line of a securely mounted reflective plate having a mirror quality finish angled back from the corresponding striking surface of the club head, a centering scale, silhouetted at the base portion of the reflective plate, made up of short lines, 0.125 inch spaced increment deviations on either side of the center line in progressive numerical order to allow the golfer to compensate for contours of putting surfaces, a grip reasonably secured to a shaft, of the club head having at a selected distance above the club head to the shaft, a centering standard projecting horizontally forward and parallel to the club head, an alignment mark existing near out board end of the centering standard, calibrated to the center mark of the club head, also calibrated to center line of the reflective plate, in conjunction with the reflection of alignment mark of the centering standard, thus subsequently positioning the corresponding striking surface of club head perpendicular to the reflection of the target or achieving a misaligned putt by using an offset of the centering scale right or left of center line for compensating for contoured putting surfaces of the putt being negotiated.

U.S. Pat. No. 7,927,226 is directed to a golf putter having an alignment apparatus.

ABSTRACT: Disclosed is a putter head that has a striking surface and is adapted to mount to a shaft of a putter. The putter head has an alignment apparatus, which includes a sighting device and a flat surface. The sighting device has an upright element and a base element that is symmetrically positioned around the bottom of the upright element. When viewed from above, centering the base element around the upright element every time positions a golfer's eyes and head in the same position every time. The flat surface is centered under the upright element. The flat surface whereby positioning the flat surface on a surface positions the putter head in the same relationship with the surface every time.

SUMMARY

The present invention helps golfers reduce strokes in their short game for lower scores. It corrects common problems with a putting stroke, including misalignment, inaccuracy, speed of striking, and pushing or pulling the ball to the left or the right. It effectively allows golfers to discover their natural stance, grip, and posture when putting. It improves muscle memory and creates a more routine putting motion. It builds confidence in golfers of all ages and skill levels.

This disclosure relates to a golf instruction tool that has a linear putting guide with a longitudinal axis, a putter mounting base connected to the linear putting guide through a slidable connection, and an artificial green. The linear putting guide can be placed underneath the artificial green, and the putter mounting base can be placed above the artificial green with the connection extending through a slot in the artificial green. In some versions, the linear putting guide employs a slide to provide the linear motion. In these or other embodiments, the linear putting guide comprises functionality to align the golfer's body correctly above the tool. In some versions, a mirror mounted on a mirror mount connected to the putter mounting base serves to align the golfer's body above the tool.

In some embodiments, the linear putting guide provides 10 inches of linear range, which provides 10 inches of linear travel to the putter mounting base. The putter mounting base has a putter interface that secures the putter to the putter mounting base through an interference or friction fit. In some embodiments, the tool also has a club alignment guide extending up from the putter mounting base perpendicular to the longitudinal axis. In some versions, the mirror mount and mirror connect on the base's front, the putter interface mounts on the base's back, and the alignment guide sits between the mirror and the interface. The alignment guide is spaced apart from the interface in some embodiments. In some embodiments, the space between the alignment guide and the putter interface receives the head of a golf club and interacts with the putter mounting base through friction or an interference fit. Some versions comprise a gravity ball feed and a movable cup. In some versions, the artificial green is imprinted or otherwise marked with various graphics to facilitate instruction with the tool. Related methods are also disclosed. These include providing the tool, placing the club in the tool, practicing a back stroke and a forward stroke, and in some cases, periodically practicing an actual put with an actual golf ball.

For purposes of summarizing the invention, certain aspects, advantages, and novel features of the invention have been described herein. It is to be understood that not necessarily all such advantages may be achieved by any single embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood by referencing the following drawings and detailed description.

BRIEF DESCRIPTION OF THE DRAWINGS

The figures which accompany the written portion of this specification illustrate embodiments and methods of use for the present disclosure, a surface staining composition and method, constructed and operative according to the teachings of the present disclosure.

The various embodiments of the present invention will be described in conjunction with the appended drawings, wherein like designations denote like elements.

DETAILED DESCRIPTION

The One Putt System provides an effective and convenient way for golfers to practice their short game consistently. This innovative product features an 8' putting green, made from felt or other imitation material. The putting green can have a linear slide guide, accompanied by an affixed movable putter resting/secure base, made of a steel bracket and cut sponge, connected in precision alignment. The linear slide guide can be located under the green, hidden from view, and the movable putter resting/secure base can be positioned on a putter for straight back-and-forth practice. A small square mirror can be affixed to the front of the movable putter resting/secure base. Additionally, the green can have a gravity ball feed, made of foam or other suitable material, and a running track to feed golf balls to users. Varying distance markers can be added to the putting green's surface to track length accuracy. The green may also have marks to work on the touch/strength of ball striking of short distance putting. The putting green can also have movable cups or holes to practice aim and accuracy. The exact specifications may vary upon manufacturing.

Components:

| | |
|---|---|
| golfer | 10 |
| club | 20 |
| club head | 21 |
| clubface | 22 |
| golf ball or ball | 30 |
| golf instruction tool | 100 |
| artificial green | 101 |
| movable cup | 110 |
| gravity ball feed | 120 |
| putter mounting base | 130 |
| ball position | 140 |
| linear putting guide | 510 |

-continued

| | |
|---|---|
| slot | 150 |
| mirror mount | 610 |
| mirror | 620 |
| golfer reflection | 625 |
| club alignment guide | 630 |
| slide | 810 |
| steel bracket | 820 |
| sponge | 830 |
| connection | 910 |

Figure 1:
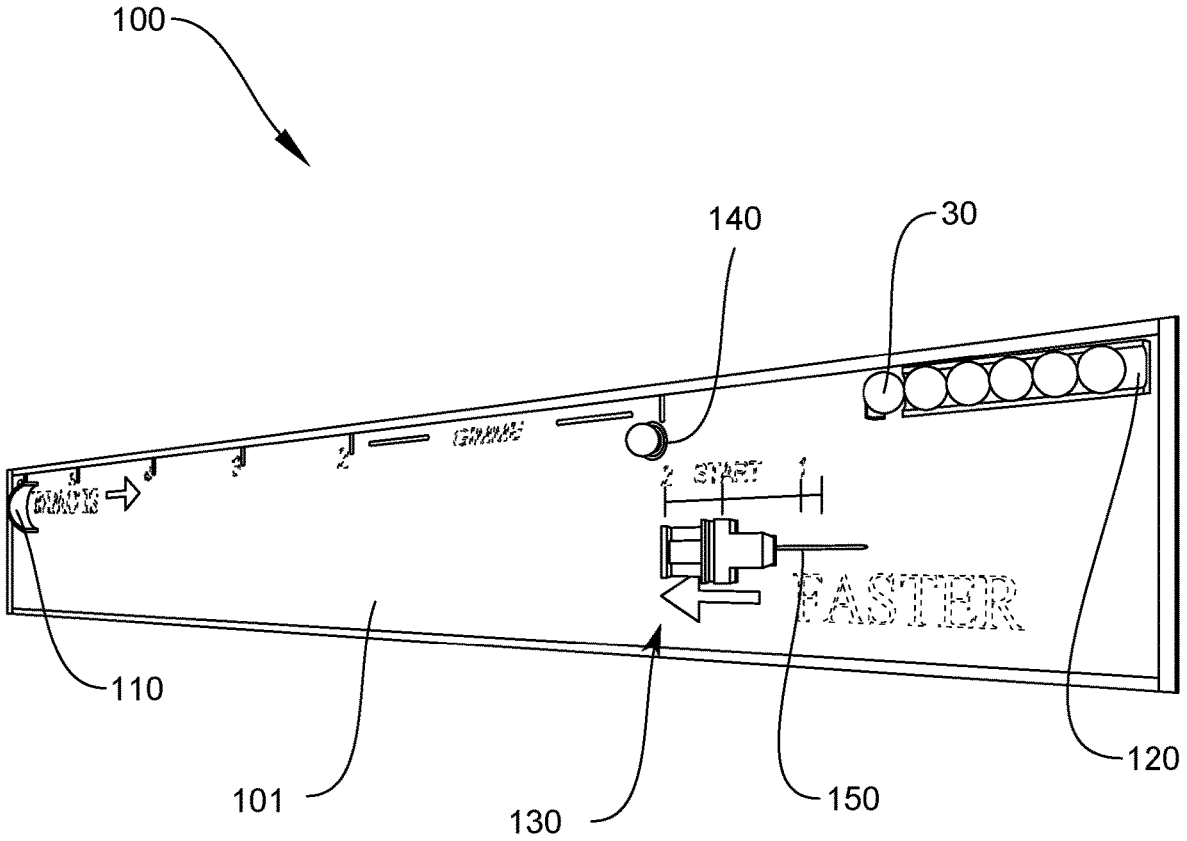
FIG. 1 is a perspective view of the golf instruction tool of the current disclosure.

FIG. 1 depicts golf instruction tool 100 with golf ball 30. In this embodiment, golf instruction tool 100 has movable cup 110, gravity ball feed 120, putter mounting base 130, and various graphics printed on artificial green 101. For instance, ball target or ball position 140 is shown with golf ball 30 resting upon it.

Figure 8:
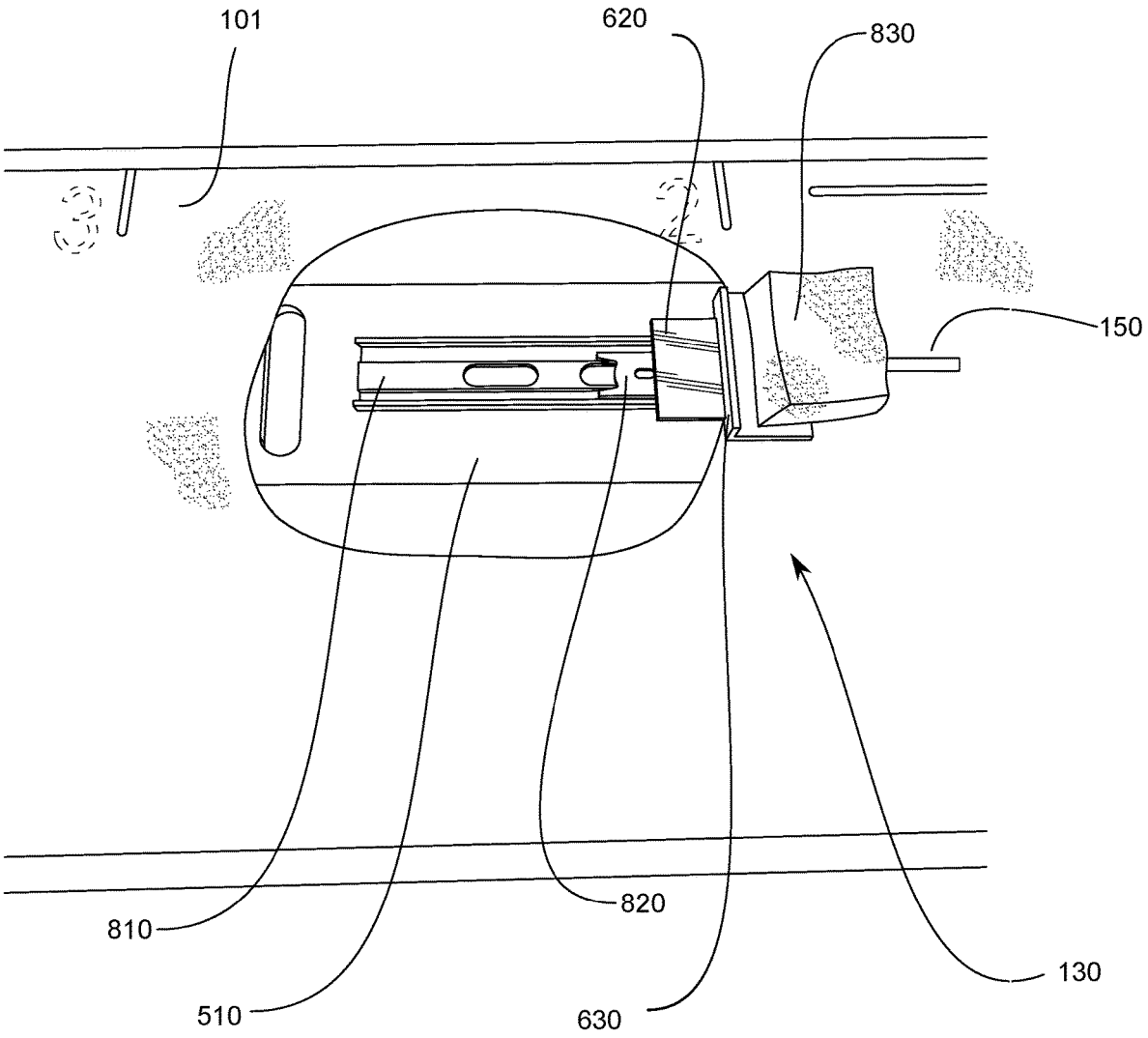
FIG. 8 is an upper perspective view of a linear guide according to a tool of the current disclosure.

Linear putting guide 510, best seen in FIG. 8, is disposed underneath artificial green 101. Putter mounting base 130 rides in or on linear putting guide 510 in use. Artificial green 101 is nominally 8 feet long but can be longer or shorter depending upon the embodiment. One factor that influences the length of artificial green 101 is that golf instruction tool 100, in some embodiments, is configured to provide putting instruction to a golfer 10 rather than instruction on some longer stroke. Movable cup 110 may be position along artificial green 101 to vary the length of the put. In this figure, slot 150 is shown passing through artificial green 101.

Figure 2:
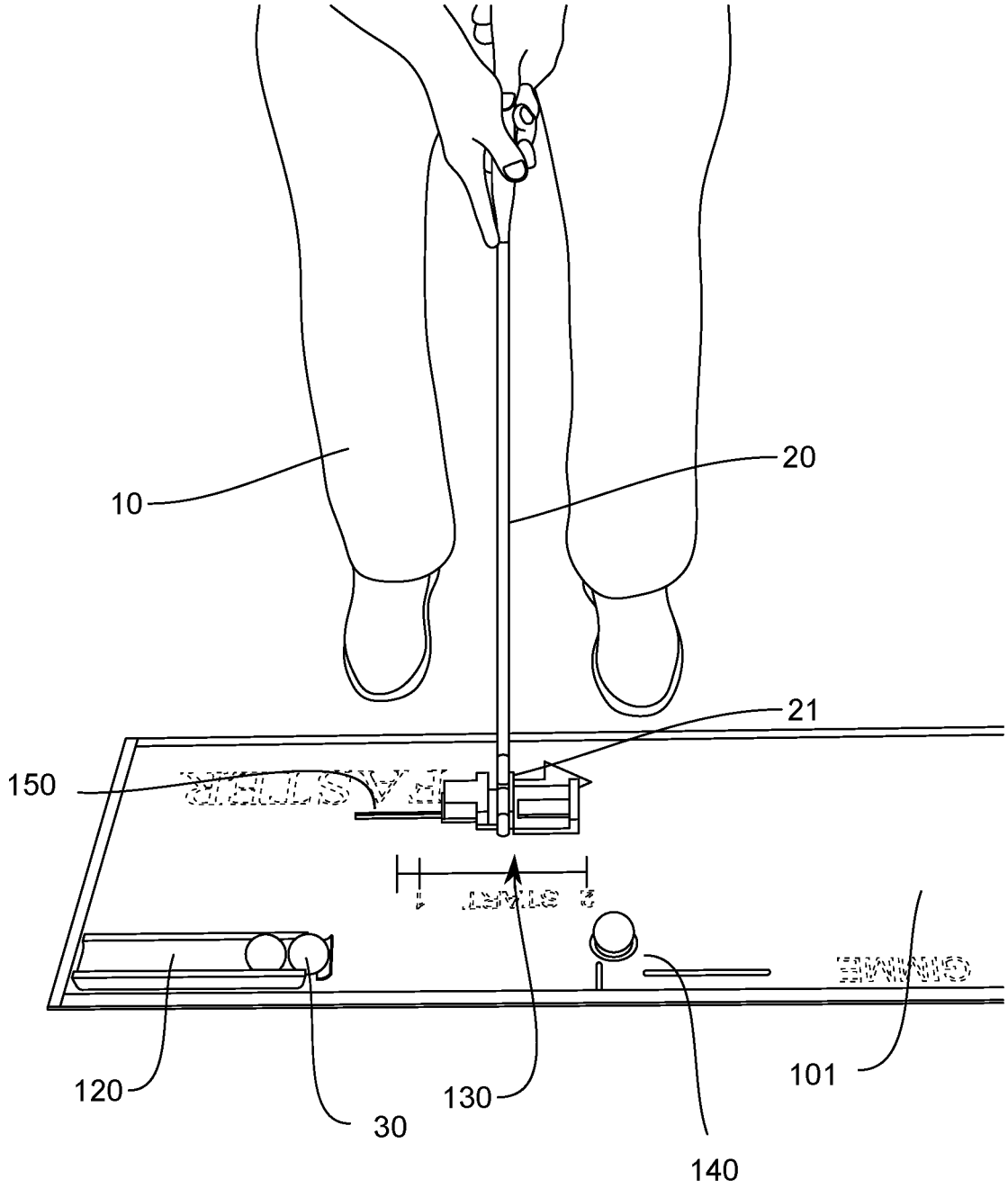
FIG. 2 is a perspective view of a portion of the tool of FIG. 1.

FIG. 2 shows an alternative view of a portion of golf instruction tool 100 in use. As depicted, golfer 10 is holding club or putter 20 in position for practice. As before, the figure depicts gravity ball feed 120, putter mounting base 130, and ball position 140.

Figure 3:
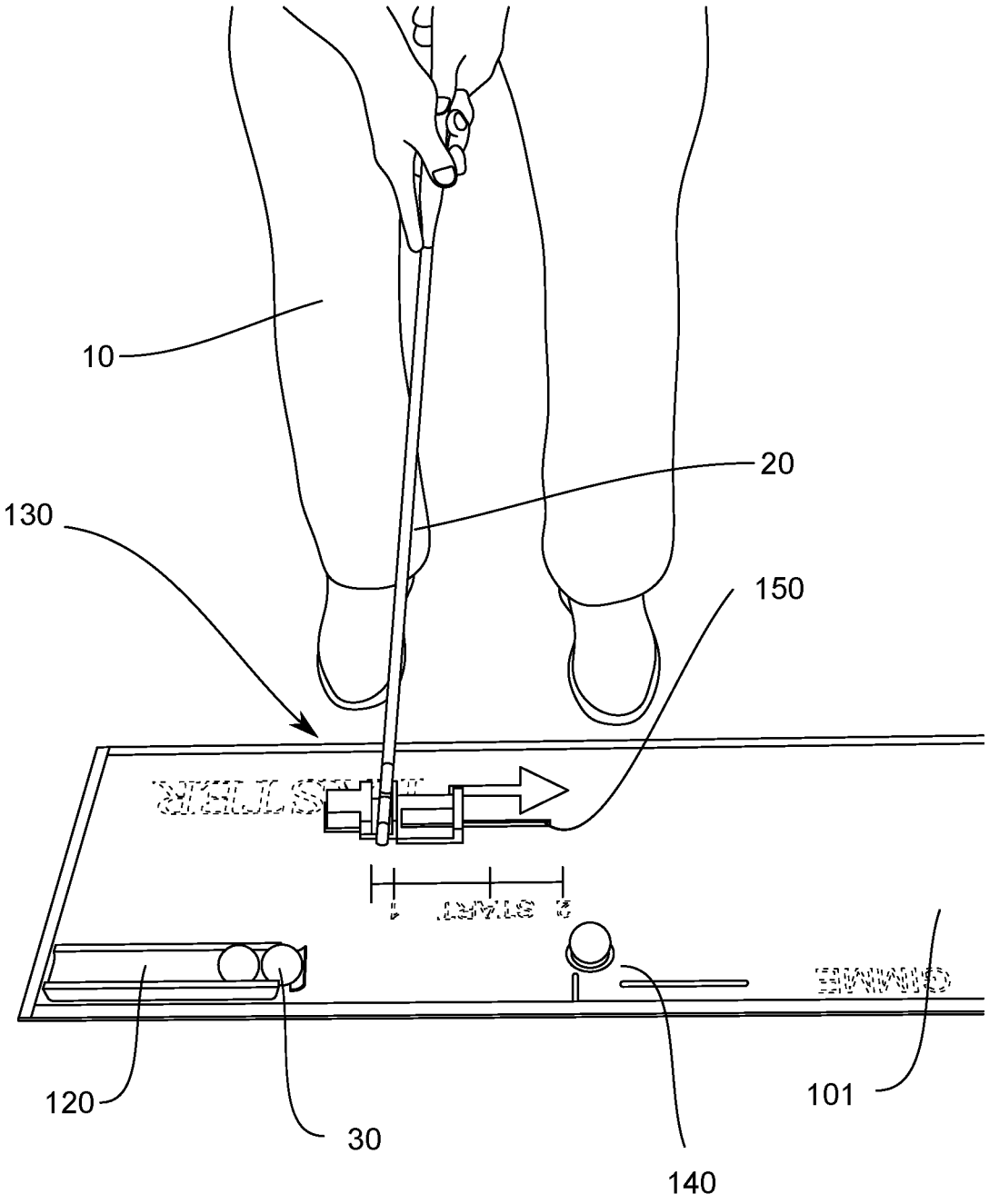
FIG. 3 is another view of FIG. 2.
Figure 4:
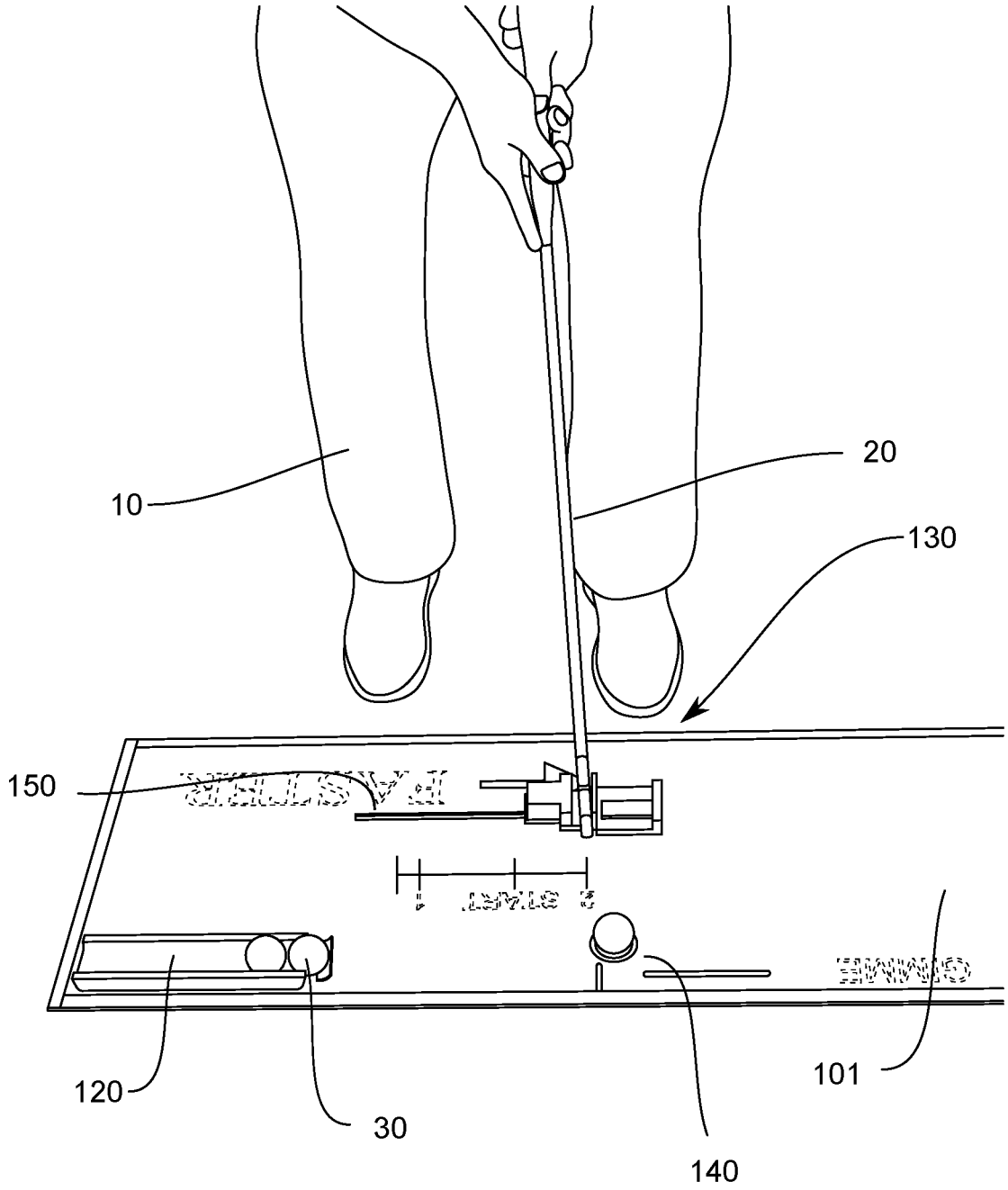
FIG. 4 is another view of FIG. 2.

FIG. 3 shows another view of FIG. 2. In this figure, golfer 10 has swung backward with club head 21 firmly pushed onto putter mounting base 130. FIG. 4 shows the same view except golfer 10 has swung club 20 forward. FIG. 4 also shows gravity ball feed 120 and ball position 140.

Figure 5:
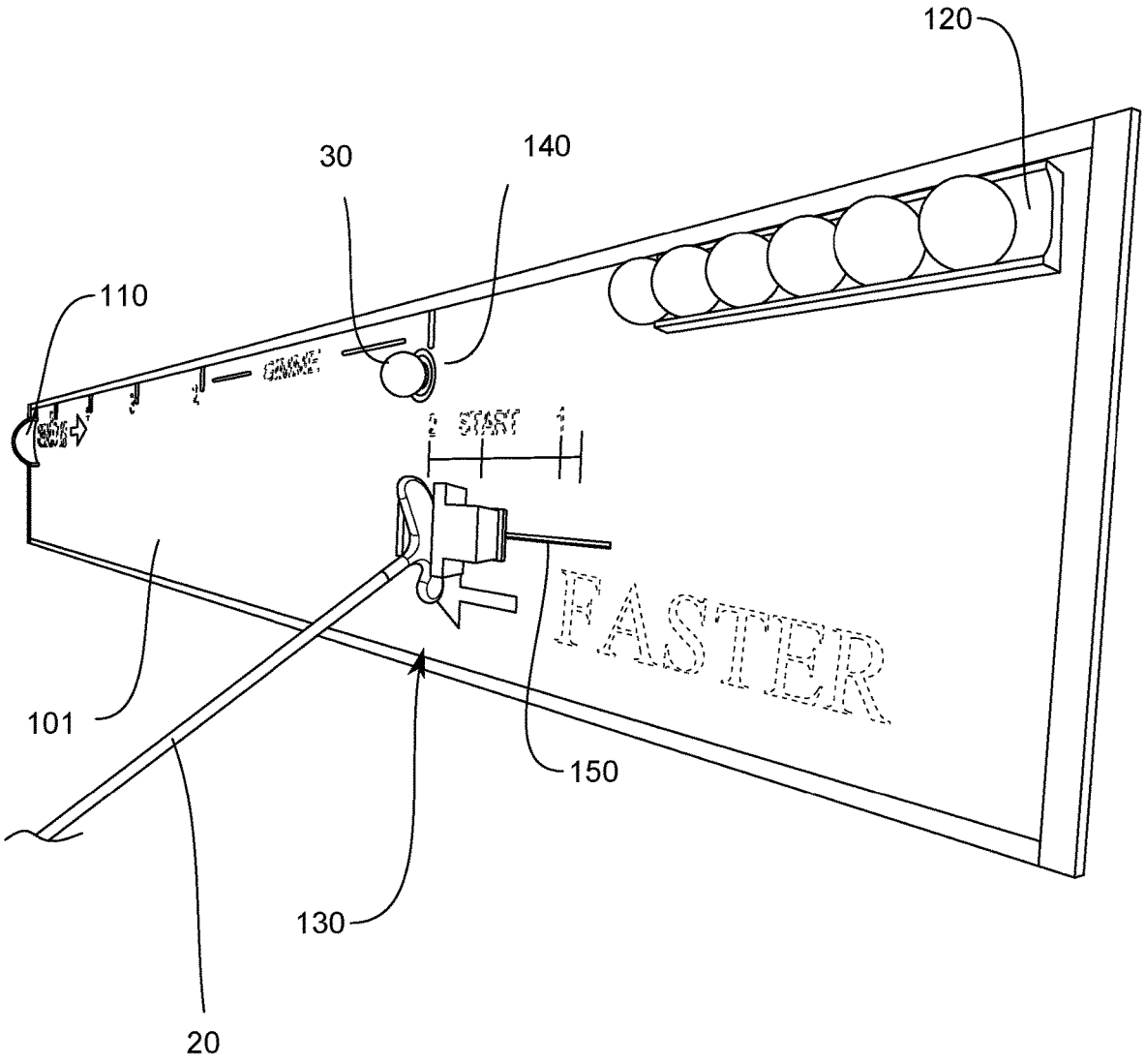
FIG. 5 is a perspective view of a tool of the current disclosure.

FIG. 5 shows an alternative view of FIG. 1 having gravity ball feed 120 and ball position 140. Linear putting guide 510 is below artificial green 101, and the connection between linear putting guide 510 and the bottom of putter mounting base 130 passes through slot 150. (Linear putting guide 510 is best seen in FIG. 8.) Slot 150 allows putter mounting base 130 to slide along linear putting guide 510.

Figure 6:
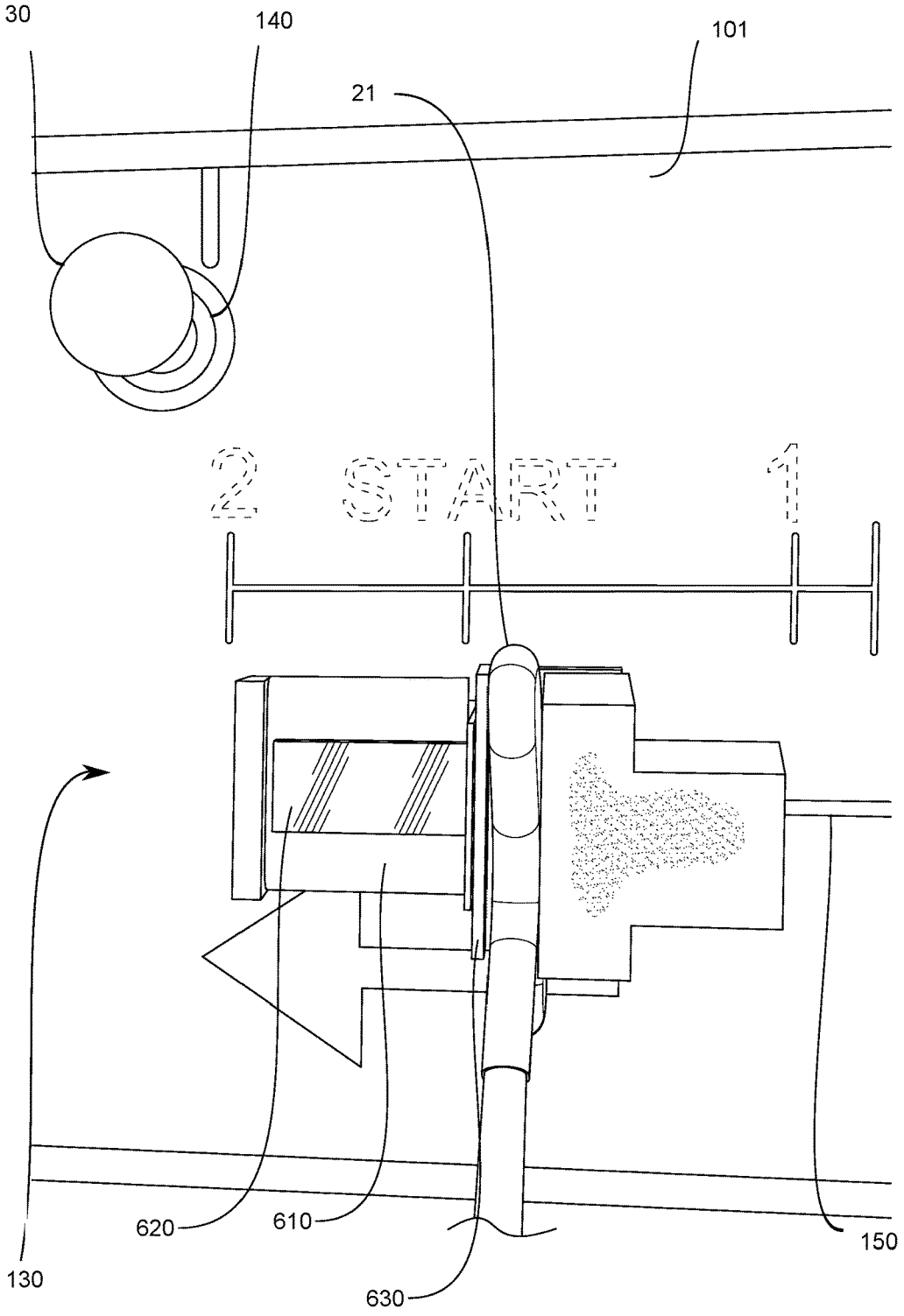
FIG. 6 is an upper perspective view of a putter mounting block according to a tool the current disclosure.

FIG. 6 shows a zoomed-in view of putter mounting base 130. This figure shows mirror mount 610 with mirror 620 mounted at or near the front portion of putter mounting base 130. The figure also shows slot 150 and ball position 140. In this figure, graphics are imprinted or otherwise marked on the artificial green 101 showing where golfer 10 should start the put, the first part of the stroke (back stroke), and the second part of the stroke.

Figure 7:
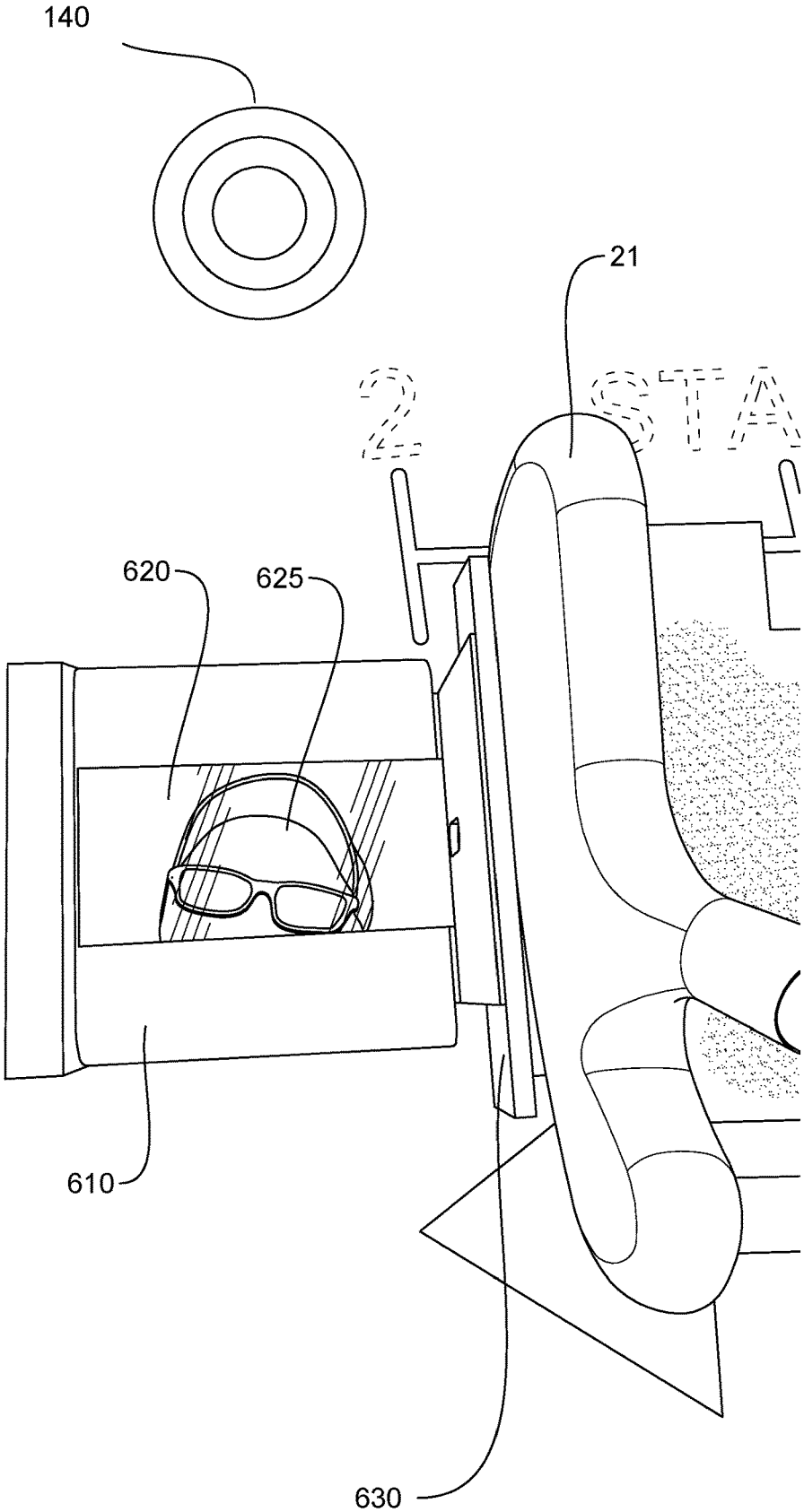
FIG. 7 is an upper perspective view of a putter mounting block according to a tool the current disclosure.

FIG. 7 is similar to FIG. 6. It shows ball position 140, club head 21, mirror mount 610, and mirror 620. In this figure, golfer reflection 625 appears in mirror 620, indicating to golfer 10 that he or she has correctly aligned his or her body over putter mounting base 130. FIG. 7 also shows clubface 22 held square to the direction of the stroke by club alignment guide 630. Club alignment guide 630 extends up from putter mounting base 130 perpendicular to the travel direction of putter mounting base 130 as it moves.

FIG. 8 shows linear putting guide 510 as it appears under artificial green 101 when the tool is in use. Linear putting guide 510 has slide 810 that causes putter mounting base 130 to move linearly. Bracket or steel bracket 820 rides on slide 810 and connects putter mounting base 130 with slide 810 with the connection extending through slot 150. FIG. 8 also shows the material of putter interface 830, which in some cases, is a sponge-like or rubber-like material. Putter interface 830 holds putter 20 in place on putter mounting base 130 without any kind of permanent or physical connection. Friction or interference between club head 21 and interface 830 maintains club 20 on putter mounting base 130. In some embodiments, interface 830 is made of a material that supplies sufficient friction to hold club head 21 in place during the practice shots.

Figure 9:
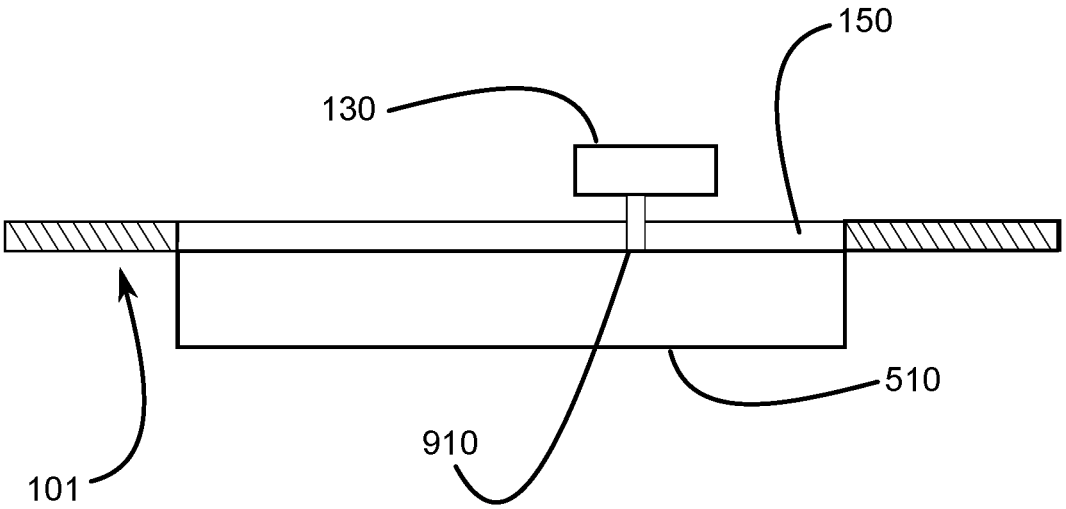
FIG. 9 is a schematic cross-section view of the tool of the disclosure.

FIG. 9 shows a schematic cross-section view of the device with linear putting guide 510, connected to putter mounting base 130 through connection 910. Connection 910 resides in slot 150 of artificial green 101.

In operation, golfer 10 places club 20 onto interface 830, which is connected to putter mounting base 130. Additionally, golfer 10 aligns clubface 22 on or against club alignment guide 630.

Following the graphics, golfer 10 begins this shot with a backswing. Since club head 21 interacts with putter mounting base 130 because of interface 830, the backswing moves putter mounting base 130 backward in slot 150. Since putter mounting base 130 is attached to linear putting guide 510, slide 810 causes the putter to move backward along slide 810. As seen in FIG. 3, golfer 10 then makes the stroke, ending near the end of the graphics. Again, since putter mounting base 130 is attached to linear putting guide 510, slide 810 causes the stroke to move forward linearly. Methodical practice of this stroke movement with golf instruction tool 100 allows golfer 10 to develop a feel and develop muscle memory for moving putter 20 backward and forward linearly using a correct stroke length. After several moments of developing the feel for the put using instruction tool 100, golfer 10 moves forward to ball 30 at ball position 140 and makes a practice stroke with a real golf ball. Muscle memory remains even after club 20 is no longer attached to putter mounting base 130. In some versions, golfer 10 aims at movable cup 110. Then golfer 10 activates gravity ball feed 120 so that it feeds another ball 30 to be placed on ball position 140. Along with this, club alignment guide 630 holds club head 21 on putter mounting base 130 perpendicular to the stroke direction, and since club 20 rests against club alignment guide 630, putter mounting base 130 and club alignment guide 630 hold club 20 in a consistent manner. This consistency helps golfer 10 develop a feel for and develop muscle memory for holding club 20 square to the ball when practicing and putting.

Methodical practice with club 20 held in the right place and with the stroke moving backward linearly and then forward linearly allows golfer 10 to develop a feel for directing his or her muscles correctly to make the golf stroke successfully. Methodical practice develops muscle memory so that golfer 10 can consciously or unconsciously remember the feeling of holding club 20 correctly and stroking the put correctly.

The embodiments of the invention described herein are exemplary, and numerous modifications, variations, and rearrangements can be readily envisioned to achieve substantially equivalent results, all of which are intended to be embraced within the spirit and scope of the invention.

The steps described in the method of use can be carried out in many different orders according to user preference. The use of "step of" should not be interpreted as "step for", in the claims herein and is not intended to invoke the provisions of 35 U.S.C. § 112(f).

What is claimed is:

1. A golf instruction tool comprising:

a linear putting guide having a slide and defining a longitudinal axis, a putter mounting base having a mirror and a connection to the linear putting guide wherein the connection is slidable, and an artificial green comprising a slot through which the connection extends, wherein the linear putting guide is disposed beneath the artificial green, and the putter mounting base is disposed above the artificial green.

2. The tool of claim 1, wherein the linear putting guide has 10 inches of linear range providing the putter mounting base with 10 inches of linear travel.

3. The tool of claim 2, wherein the putter mounting base further comprises a putter interface.

4. The tool of claim 3, further comprising a club alignment guide extending up from the putter mounting base perpendicular to the axis.

5. The tool of claim 4, wherein the club alignment guide is behind the mirror and in front of and spaced from the interface.

6. The tool of claim 5, wherein the putter interface secures the putter on or to the mounting base with an interference or friction fit.

7. The tool of claim 6, wherein the connection is a steel bracket slidably attached between the putter mounting base and the slide.

8. The tool of claim 7, wherein the putter mounting base further comprises a mirror mount with the mirror attached to the mirror mount.

9. The tool of claim 8, further comprising a gravity ball feed.

10. The tool of claim 9, further comprising a movable cup.

11. A golf instruction tool comprising:

an artificial green;

a linear putting guide having a longitudinal axis defined by a slide and 10 inches of linear travel along the slide wherein the guide is disposed beneath the artificial green;

a putter mounting base connected to the linear putting guide through a slot in the artificial green and disposed above the artificial green;

a mirror and mirror mount connected on a front of the putter mounting base;

a putter interface connected on a back of the putter mounting base;

a club alignment guide extending up from the putter mounting base perpendicular to the axis located behind the mirror and in front of and spaced from the interface;

a movable cup connected on top of the artificial green; and a gravity ball feed connected on top of the artificial green.

12. A method of golf instruction comprising:

providing a golf instruction tool having a linear putting guide having a slide and defining a longitudinal axis, a putter mounting base having a mirror and a connection to the linear putting guide wherein the connection is slidable, and an artificial green comprising a slot through which the connection extends, wherein the linear putting guide is disposed beneath the artificial green, and the putter mounting base is disposed above the artificial green;

placing a golf club on the putter mounting base;

executing a back stroke;

and executing a forward stroke, wherein the linear putting guide constrains the forward stroke and back stroke to a linear path along the longitudinal axis.

13. The method of claim 12, wherein the golf instruction tool further comprises a mirror mount attached on the front of the putter mounting base and a mirror attached to the mirror mount and further comprising the step of aligning the golfer above the putter mounting base using the mirror.

14. The method of claim 13, wherein the putter mounting base further comprises a putter interface at the back of the putter mounting base.

15. The method of claim 14, wherein the putter mounting base further comprises a club alignment guide extending up from the putter mounting base perpendicular to the axis, located behind the mirror, and in front of and spaced apart from the interface.

16. The method of claim 15, further comprising placing a golf club face against the club alignment guide.

* * * * *